US006196188B1

(12) United States Patent
Janic et al.

(10) Patent No.: US 6,196,188 B1
(45) Date of Patent: Mar. 6, 2001

(54) SYSTEM AND METHOD FOR MAINTAINING A CONSTANT THROTTLE DEADBAND

(76) Inventors: Dusan M. Janic, 991 S. 525 W.; Randal L. Bergstedt, 4391 N. Drummond Dr., both of Columbus, OH (US) 47201

( * ) Notice: Subject to any disclaimer, the term of this patent is extended or adjusted under 35 U.S.C. 154(b) by 0 days.

(21) Appl. No.: 09/354,613

(22) Filed: Jul. 15, 1999

(51) Int. Cl.[7] ..... F02D 41/26
(52) U.S. Cl. ..... 123/350; 123/683
(58) Field of Search ..... 123/350, 361, 123/683, 687, 399

(56) References Cited

U.S. PATENT DOCUMENTS

| | | | | |
|---|---|---|---|---|
| 4,356,961 | | 11/1982 | Smith . | |
| 4,453,517 | | 6/1984 | Kasiewicz . | |
| 4,506,642 | | 3/1985 | Pfalzgraf et al. . | |
| 4,539,956 | | 9/1985 | Hengel et al. . | |
| 4,651,694 | | 3/1987 | Kataoka . | |
| 4,740,898 | * | 4/1988 | McKee et al. | 364/426 |
| 5,062,404 | | 11/1991 | Scotson et al. . | |
| 5,329,455 | | 7/1994 | Oo et al. . | |
| 5,333,109 | | 7/1994 | Oo et al. . | |
| 5,445,126 | | 8/1995 | Graves, Jr. . | |
| 5,477,827 | | 12/1995 | Weisman, II et al. . | |
| 5,528,500 | | 6/1996 | Al-Charif et al. . | |
| 5,553,589 | | 9/1996 | Middleton et al. . | |
| 5,680,024 | | 10/1997 | Ehle et al. . | |
| 5,890,470 | | 4/1999 | Woon et al. . | |
| 6,073,074 | * | 6/2000 | Saito et al. | 123/350 |
| 6,079,390 | * | 6/2000 | Hashimoto et al. | 123/399 |

* cited by examiner

*Primary Examiner*—Erick Solis

(57) ABSTRACT

A system for controlling fueling signals provided to a fueling system of an internal combustion engine operates to eliminate the throttle deadband when the engine speed is limited to speeds less than the maximum engine speed. In one embodiment, the engine control module is modified to incorporate an additional throttle factor operable to scale the calculated throttle derived from the operator commanded throttle position. In one aspect of the invention, this throttle factor is a function of the ratio of the difference between a user-requested high idle breakpoint speed and the minimum engine speed, and difference between the minimum and maximum engine speeds. Thus, the relationship between engine speed and throttle input is rescaled to eliminate the deadband. Where this relationship is linear, the present invention essentially alters the slope of the line between the minimum and maximum throttle positions. The resulting rescaled commanded throttle value is then fed to the routines within the ECM that calculate a fueling command as a function of current engine speed and commanded throttle.

12 Claims, 5 Drawing Sheets

SYSTEM AND METHOD FOR MAINTAINING A CONSTANT THROTTLE DEADBAND

BACKGROUND OF THE INVENTION

The present invention concerns a system and method for maintaining a constant throttle deadband for an electronically controlled engine. More specifically, the invention provides a system for maintaining the throttle deadband as engine speed breakpoints are modified.

In most automotive and industrial application the internal combustion engines are electronically controlled. In a typical engine control system, a microprocessor receives data from ambient condition and engine-related sensors. The microprocessor then evaluates this data to determine the amount of fuel provided to each engine cylinder.

A typical system is depicted in the block diagram of FIG. 1. In this system, an engine 10 includes a fueling system 12. The fueling system can be of a variety of known types that are operable to provide a particular air-fuel mixture to the engine cylinders. In a typical automotive engine, the fueling system 12 includes an array of fuel injectors that can be individually modulated to provide varying amounts of fuel to the engine cylinders. Specifically, the fueling system 12 operates in response to control signals 13 generated by a fueling command component 14. The fueling company component 14 is generally a software program resident within an engine control module 15. The engine control module 15 receives an engine speed signal 17 from an engine speed sensor 18 affiliated with the engine 10. This speed signal 17 is provided to the fueling command component. In addition, the ECM 15 includes a commanded throttle control component 20. The commanded throttle control component. 20 receives an input signal 22 from a throttle position sensor 24. The position sensor 24 determines an operator requested position of input, such as throttle pedal 25, as it is manipulated by the driver of the vehicle. Typically, the throttle position sensor 24 provides a position signal 22 voltage that is a direct measure of the angle of the throttle pedal 25. The control component 20 then translates that voltage to a magnitude signal or commanded throttle valve.

The fueling command component 14 receives the engine speed signal 17 and a commanded throttle value generated by the component 20. The fueling command component of the ECM then evaluates this input in light of preprogrammed fueling protocols to generate an appropriate fueling command signal 13 for the fueling system 12.

In a typical internal combustion engine, the greater that the pedal 25 is depressed, the greater the amount of fuel provided to the engine 10 by the fueling system 12. In a simple system, the resulting engine speed is linearly related to the position of the throttle pedal 25, as reflected in the graph of FIG. 2. When the pedal 25 is at its neutral, or zero throttle position, the engine is operating at its minimum or low idle speed. When the throttle pedal 25 is fully depressed, or at its maximum position, the engine speed is also at its maximum rpm value. It is understood that FIG. 2 is simply an idealized representation of the relationship between throttle position and engine speed. Of course, other relationships can be implemented in many types of engine control systems. Typically, an algorithm or a table-look-up procedure is utilized to extract a fueling command based upon the sensed position of the vehicle throttle.

In many engine control systems, an engine speed breakpoint (BP) is provided or monitored by the engine control module 15. This breakpoint corresponds to an established maximum permitted engine speed that is less than the unregulated maximum engine speed at the maximum throttle position. The breakpoint can be correlated to an engine speed control in that the engine speed will not increase beyond the breakpoint regardless of how far the throttle pedal 25 is depressed. By way of example, referring again to FIG. 2, two throttle breakpoints $BP_1$ and $BP_2$ are depicted. These two breakpoints can be preset by the engine manufacturer, or in a more typical situation, can be established by the vehicle operator. As illustrated in FIG. 2, as the vehicle throttle is depressed from its zero position, the relationship between the throttle position and engine speed follows the standard curve $C_0$ (which follows a linear relationship in the specific embodiment.) However, when the engine speed reaches one of the breakpoint values, either $BP_1$ or $BP_2$ any further movement of the throttle does not result in an increase in engine speed. In other words, once the vehicle engine speed has reached a breakpoint value, the fueling command component 14 essentially overrides the commanded throttle component 20 so that the fueling command ignores the throttle position. On the other hand, once the engine speed drops below the breakpoint value, the fueling command routine 14 again determines the fueling command signal 13 as a function of throttle position.

In a typical electronically controlled engine, the portion of the throttle travel that has no effect on engine speed is referred to as the "deadband". In other words, when the throttle is within the deadband, any modulation of the throttle pedal 25 is essentially irrelevant to determining the amount of fuel commanded at the fueling system 12. As can be discerned from FIG. 2, this deadband increases as the breakpoint engine speed decreases. This deadband thus, corresponds to a segment of travel of the throttle pedal 25 that produces no change in engine speed—whether increasing as the pedal is depressed, or decreasing when the pedal is released. FIG. 2 is for illustrative purposes only so that the actual length of the throttle deadband will vary depending upon the particular engine control and throttle system.

A throttle deadband is inherently undesirable because it has a tendency to produce inaccurate or unpredictable engine speed control. This problem is accentuated as the high speed or high idle breakpoint is decreased. When the deadband is increased, the amount of throttle travel between the engine minimum speed ($N_{min}$) and the maximum allowable engine speed (i.e., the speed at the breakpoint) is very limited. The vehicle operator thus has less pedal travel to work with to control the engine speed and therefore the vehicle speed, within the engine speed range permitted by the breakpoint. Consequently, when a breakpoint is initiated the throttle pedal becomes a less precise or accurate method for the vehicle operator to control the vehicle speed.

There is therefore a significant need for an engine control system that allows the use of engine speed breakpoints without a commensurate loss in throttle input accuracy. This need extends to the need to eliminate the throttle deadband phenomenon that plagues current engine control systems.

SUMMARY OF THE INVENTION

In view of the difficulties associated with prior engine control systems and all-speed governors, the present invention contemplates a system and method for maintaining a constant throttle deadband under all operating circumstances. In its most preferred embodiment, the invention eliminates the throttle deadband for any operator requested breakpoint speed.

In the preferred embodiment of the invention, the engine control module is modified to incorporate an additional throttle factor operable to scale the calculated throttle from the operator commanded throttle position. More particularly, the fueling command element of the ECM can include additional software commands to calculate and apply the inventive throttle factor. In one aspect of the invention, this throttle factor is a function of the user-requested high idle breakpoint speed, the minimum engine speed and the maximum high idle or full throttle engine speed.

According to this aspect, the throttle factor is obtained from the following equation:

$$TF = \frac{B - A}{C - A},$$

where B is the user-requested breakpoint speed, A is the minimum speed and C is the maximum engine speed. This calculated throttle factor is then multiplied with the calculated throttle based on the operator commanded throttle position. The resulting resealed commanded throttle value is then fed to the routines within the ECM that calculate a fueling command as a function of current engine speed and commanded throttle.

In an additional embodiment of the invention, the throttle factor value can be modified to permit a predetermined throttle deadband when a speed breakpoint has been applied. In this embodiment, the throttle factor (TF) is itself scaled by the ratio of the maximum throttle position to the range of throttle position before the requested deadband.

One benefit of the present invention is that the throttle deadband phenomenon can be eliminated for an electronically controlled engine. Most particularly, this feature benefits engine control systems that permit the application of high idle breakpoints.

Accordingly, one object of the invention is to provide a system to eliminate a throttle deadband as desired by the vehicle operator. Another object is to achieve the benefits of this invention with only minimal change to an existing engine control system.

Other objects and benefits of the invention will become obvious upon consideration of the following written description and accompanying figures.

DESCRIPTION OF THE PREFERRED EMBODIMENTS

Figure 1:
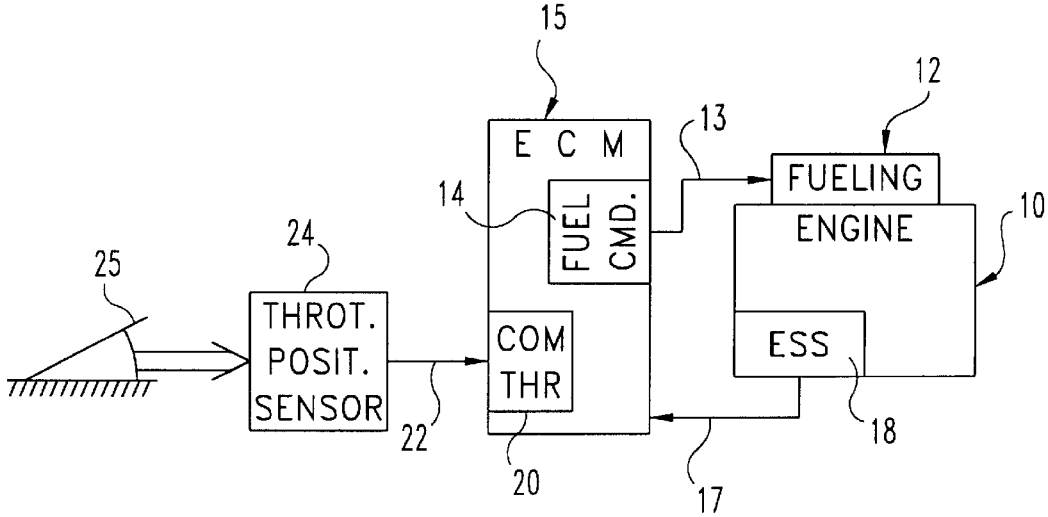
FIG. 1 is a block diagram representation of an engine, engine control system and throttle.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

The present invention is implemented in an electronic control module (ECM) for an internal combustion engine. The system can take the general form of the system shown in FIG. 1 in which the ECM 15 includes a fueling command component or algorithm 14 that determines the fuel control signal 13 fed to the fueling system 12. The component 14 retries upon engine speed and throttle position inputs to determine the requisite fueling command.

Figure 3:
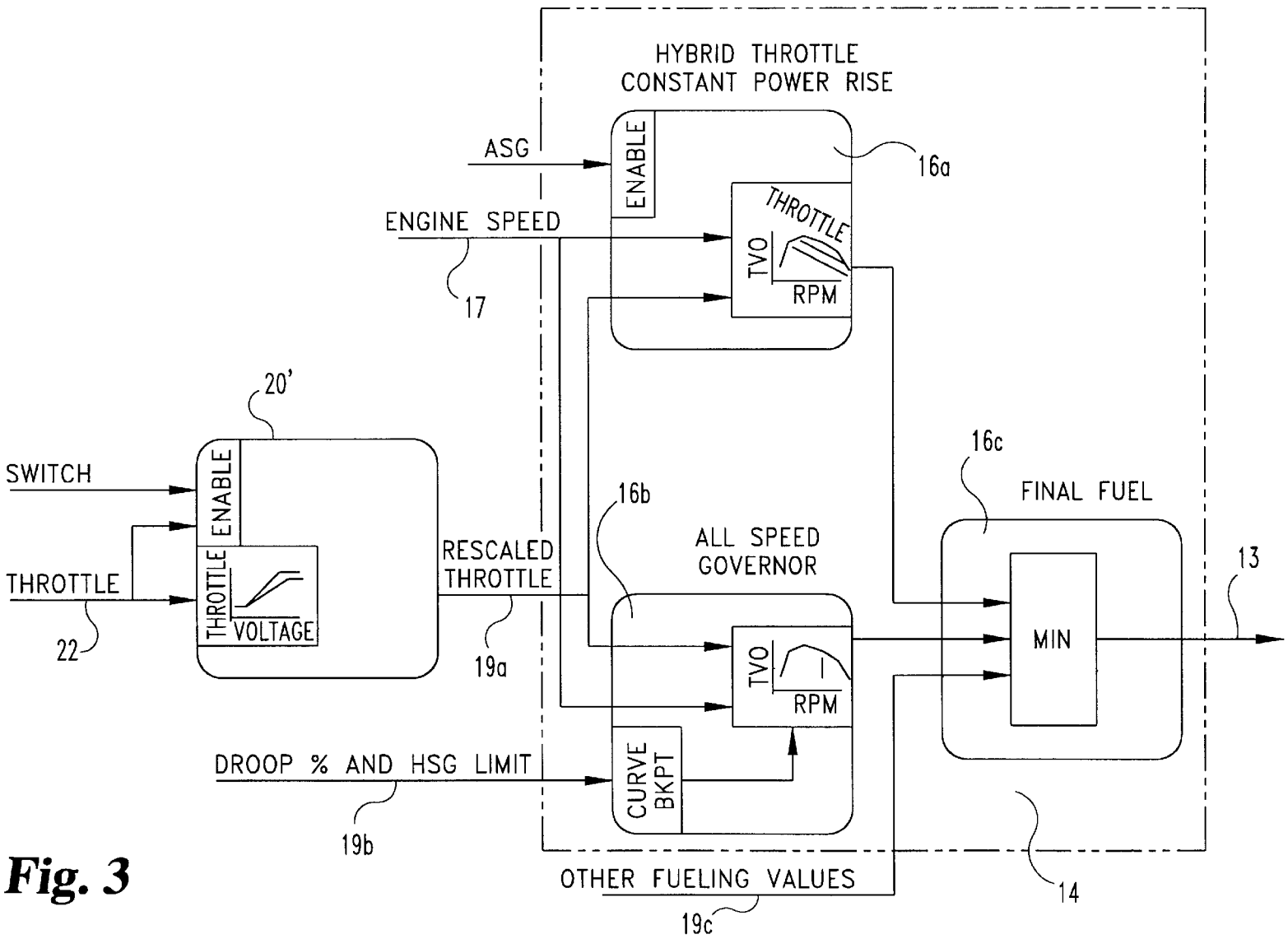
FIG. 3 is a block diagram of the commanded throttle and fueling command routines of the engine control module illustrated in FIG. 1.

Further details of the fueling command component 14 can be discerned from the block diagram of FIG. 3. In particular, the fueling command component 14 can include a hybrid throttle element 16*a* and an all speed governor 16*b*. Both of these elements receive the engine speed signal 17 as an input. The hybrid throttle 16*a* is enabled or activated by a signal from the all speed governor element 16*b*. The hybrid throttle element 16*a* allows the vehicle operator to select alternative torque curves to be applied in governing the engine speed. The all speed governor 16*b* essentially is operable to produce a constant engine speed for a constant throttle position. The all speed governor 16*b* can also incorporate a cruise control function that allows the engine speed to remain constant regardless of the load as long as the throttle is unchanged.

Figure 2:
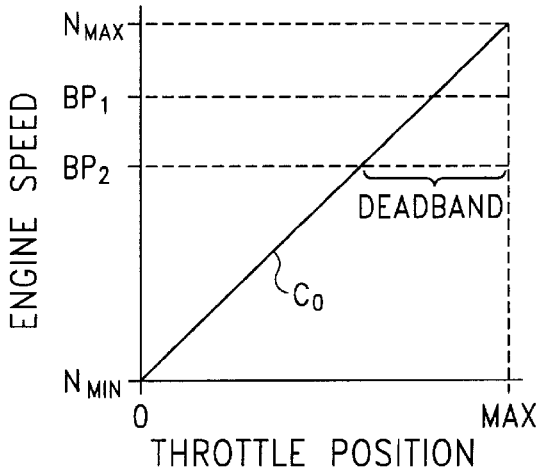
FIG. 2 is a graph illustrating an idealized relationship between throttle position and engine speed.

Both elements 16*a* and 16*b* receive a rescaled throttle signal input 19*a* that is generated by the commanded throttle component. The all speed governor 16*b* also receives additional inputs 19*b* for droop percentage and high speed governor limits. The droop function is a governor characteristic that permits the steady state engine speed to decrease slightly as engine load increases. This droop percentage value can be input by the vehicle operator or extracted from other algorithms executed by the ECM 15. The high-speed governor limit is also preferably an operator input value. The high-speed governor limit can establish the breakpoint or breakpoints depicted in FIG. 2.

The rescaled throttle signal 19*a* can be generated by commanded throttle component 20' as depicted in FIG. 3. This component receives the signal 22 from the throttle position sensor 24 as an input. Preferably, the component 20' relates the voltage of the signal 22 to a specific throttle percentage—i.e. 0 to 100%. The component 20' can be enabled or disabled by a separate input switch in combination with input from the throttle position signal 22.

In accordance with the illustrated embodiment, the fueling command component also receives additional input signals 19*c* corresponding to other fueling values. A final fuel element 16*c* receives inputs from the hybrid throttle element 16*a*, the all speed governor 16*b* and the externally supplied fueling values 19*c*. The final fueling element 16*c* then passes the minimum fueling value among the three inputs, which value becomes the fueling command signal 13 provided to the fueling system 12.

As thus far described, the engine control system, and the fueling command component 14 can be of known configuration. The components 14 and 20 are preferably implement as software routines or algorithms executed by the ECM 15 to generate the fueling signals 13. In accordance with the present invention, these routines can be modified to eliminate the throttle deadband phenomena. It is understood that the present invention has application where the engine speed is limited to a value below its standard full throttle speed. The present invention further contemplates that one or more breakpoint speeds can be invoked by the vehicle operator. Moreover, the invention accounts for circumstances in which the breakpoint speed values are either predetermined or adjustable by the operator.

Figure 4:
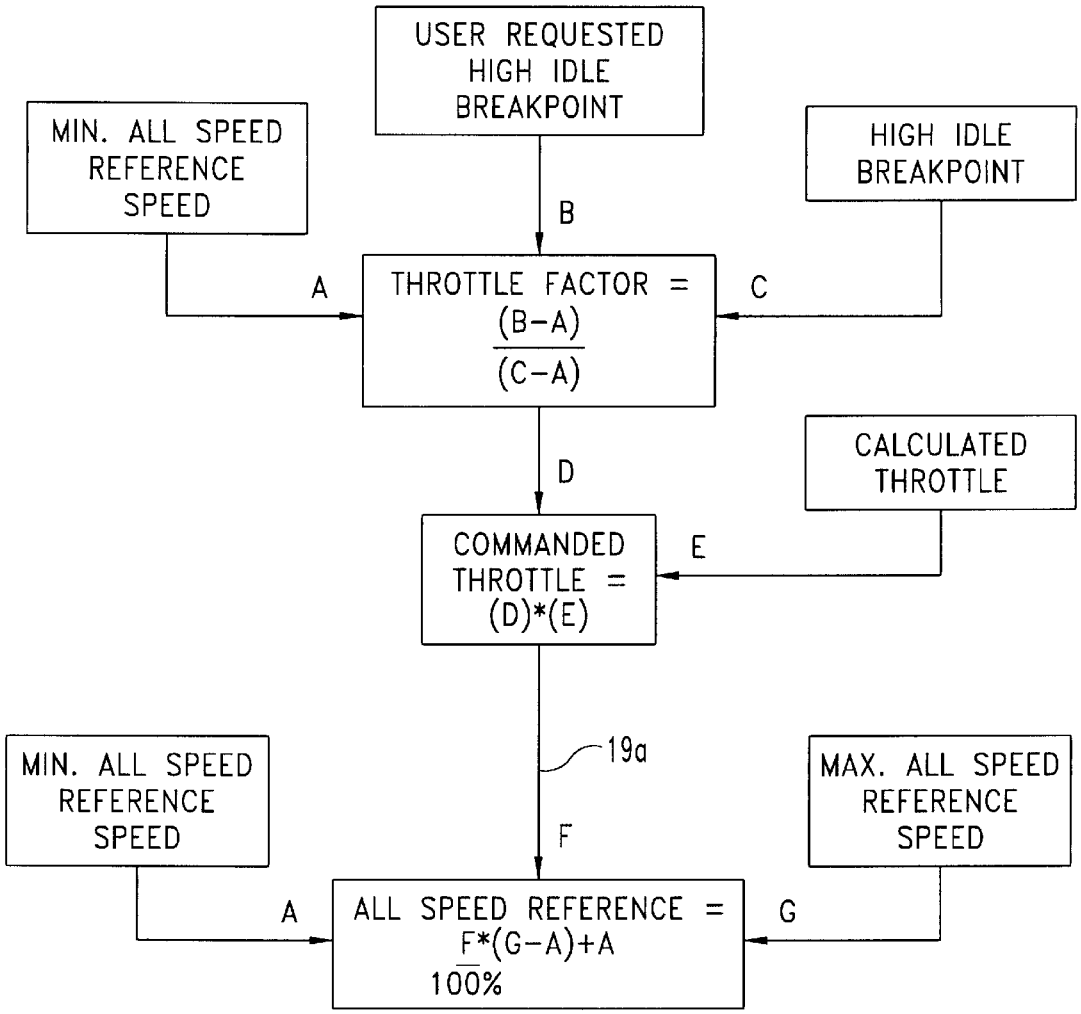
FIG. 4 is a block flow chart showing an preferred embodiment of the present invention for maintaining the throttle breakpoint.

One embodiment of the present invention is depicted in the block diagram flow chart of FIG. 4. In general terms, the present invention calculates a throttle factor that is applied to the commanded throttle to yield the rescaled throttle signal 19*a* (see FIG. 3). The throttle factor (TF) is a function of the minimum all-speed reference speed and the original rated high-speed breakpoint or maximum full throttle speed for the particular engine. These two values, represented by signals A and C in FIG. 4, are typically preset values for the specific engine. These values can correspond to the points $N_{min}$ and $N_{max}$ on the engine speed axis of the graph in FIG. 2. In the absence of a separately established breakpoint, the two speed signal values A and C represent the zero and the maximum throttle positions for the vehicle throttle pedal 25. The algorithm of the present invention contemplates an additional input, namely the user requested high idle breakpoint value B. This value B corresponds to a breakpoint speed, such as the speed values $BP_1$ or $BP_2$ shown in FIG. 2. In certain embodiments, the breakpoint values can be selected from a fixed number of predetermined breakpoint speeds, or can be separately adjusted by the vehicle operator. The user requested speed is typically a value generated by other algorithms, such as the allspeed governor element 16*b* of the fueling command component 14 (FIG. 3), based on operator inputs.

The routine of the present invention then calculates the throttle factor (TF) as the ratio of the difference between the user-requested high idle breakpoint and the minimum engine speed, relative to the difference between the original high idle breakpoint (maximum speed) and the minimum engine speed. In other words, the invention applies the following equation to determine the throttle factor:

$$TF = \frac{B - A}{C - A}$$

This throttle factor is passed as a value D to the next step of the flow chart of FIG. 4. In this next step, the commanded throttle is calculated as the product of the throttle factor D and a calculated throttle E. The calculated throttle E corresponds to the standard throttle value as a function of pedal position, and is generated in the commanded throttle component 20' of the ECM 15. This calculated throttle value E is preferably obtained from standard linearization routines which process the throttle voltage signal 22. It is understood that the calculated throttle value E can range from zero to one hundred percent. The throttle factor D can range from zero to one, where the throttle factor is zero when the user-requested high idle breakpoint value B equals the minimum engine speed value A, and equals one when the user-requested high idle breakpoint B equals the original rated high idle breakpoint C. It should thus be clear that where the user requested high idle is the same as the rated breakpoint speed, the commanded throttle value F corresponding to signal 19*a* is the same as the linearized calculated throttle value E. In this instance, there is no throttle deadband so no additional scaling of the calculated throttle is necessary.

To complete the fueling command calculation, the commanded throttle value F is provided to an all-speed reference calculation block. Additional inputs to the block are the minimum and maximum all-speed reference speed values A and G respectively. The all-speed reference value then corresponds to the engine speed calculated from the rescaled throttle input to eliminate the throttle deadband.

By way of an example, in one specific engine, the minimum reference speed value A is 600 rpm, while the maximum reference speed G or high idle breakpoint value C is 2100 rpm. In the instance in which the user-requested breakpoint is less than the maximum speed, say 1800 rpm, the throttle factor value D becomes (1800−600)/(2100−600)=0.8. When the calculated throttle is one hundred percent, meaning that the throttle pedal 25 is fully depressed to its maximum position, the commanded throttle value F equals 0.8×100%, or 80%. The all-speed reference speed then becomes 80%/100%×(2100−600)+600, or 1800 rpm. The speed reference value of 1800 rpm corresponds to the user requested high idle breakpoint speed of 1800 rpm, as would be expected because the throttle is at its maximum position.

It should be noted that in the absence of the application of the throttle factor value D in accordance with the present invention, the commanded throttle F would be the same as the calculated throttle E, namely one hundred percent. Thus, the all-speed reference value becomes simply the maximum all-speed reference speed of 2100 rpm. However, the application of the user requested high idle breakpoint B of 1800 rpm would limit the corresponding speed value provided to the final fueling element 16*c* in the fueling command component 14.

In the absence of the inventive throttle factor, any movement of the vehicle throttle 25 past the 80% calculated throttle position does not result in any corresponding change in the engine speed, due to the presence of the breakpoint. It is this deadband that is eliminated by the application of the throttle factor in accordance with the present invention. This vehicle operator thus can apply the throttle pedal 25 through its full range of motion regardless of the user requested high idle breakpoint speed. It can be seen that with the approach of the present invention, any user requested high idle breakpoint speed B will produce the same all-speed reference value in the last block of the flowchart of FIG. 4 when the calculated throttle value E is one hundred percent. Reductions in the calculated throttle E then results in proportionate reductions in engine speed from the user-requested breakpoint speed.

Figure 6A:
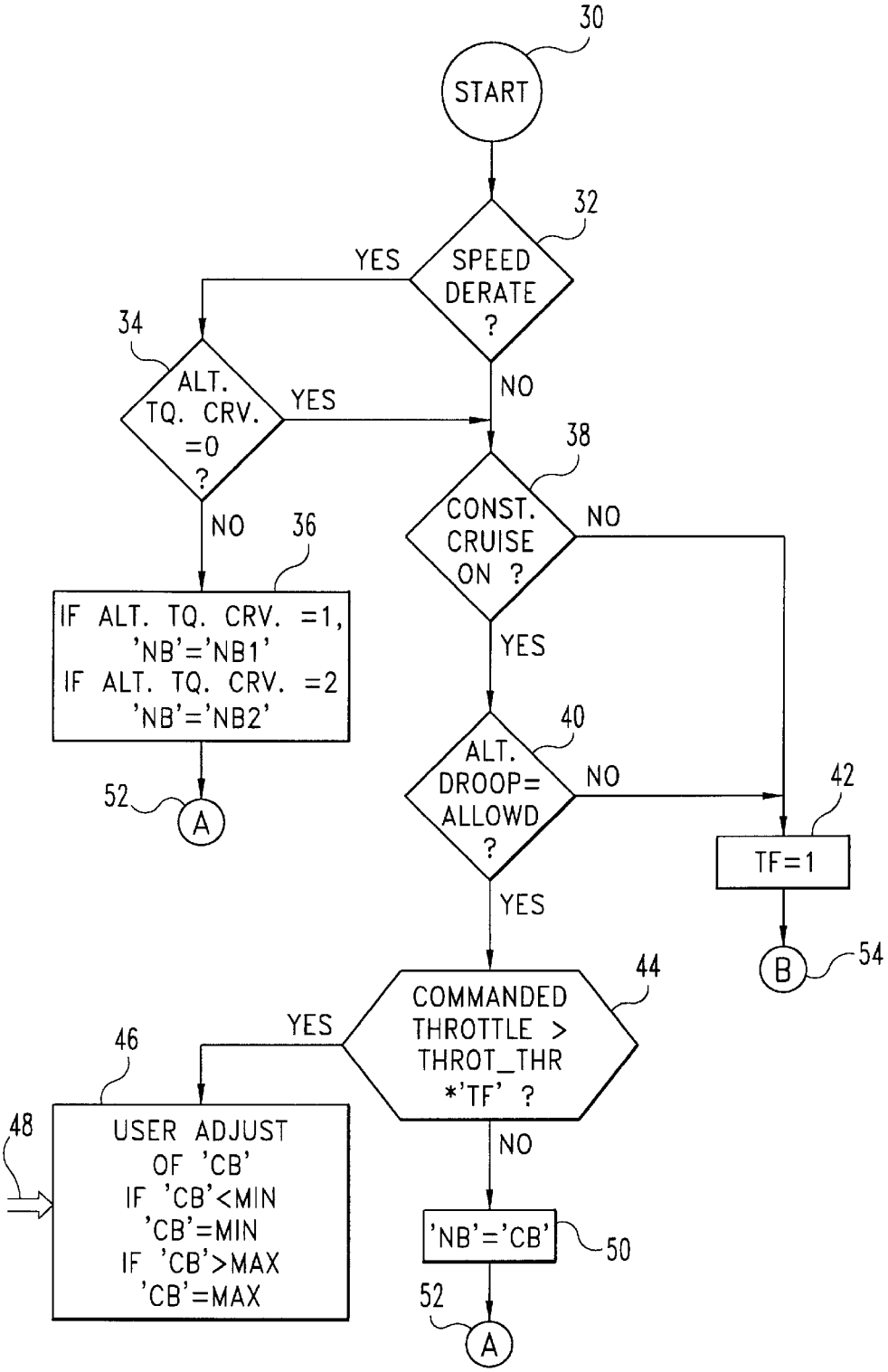
FIGS. 6*a* and 6*b* depict a flow chart of one specific embodiment of the present invention.
Figure 6B:
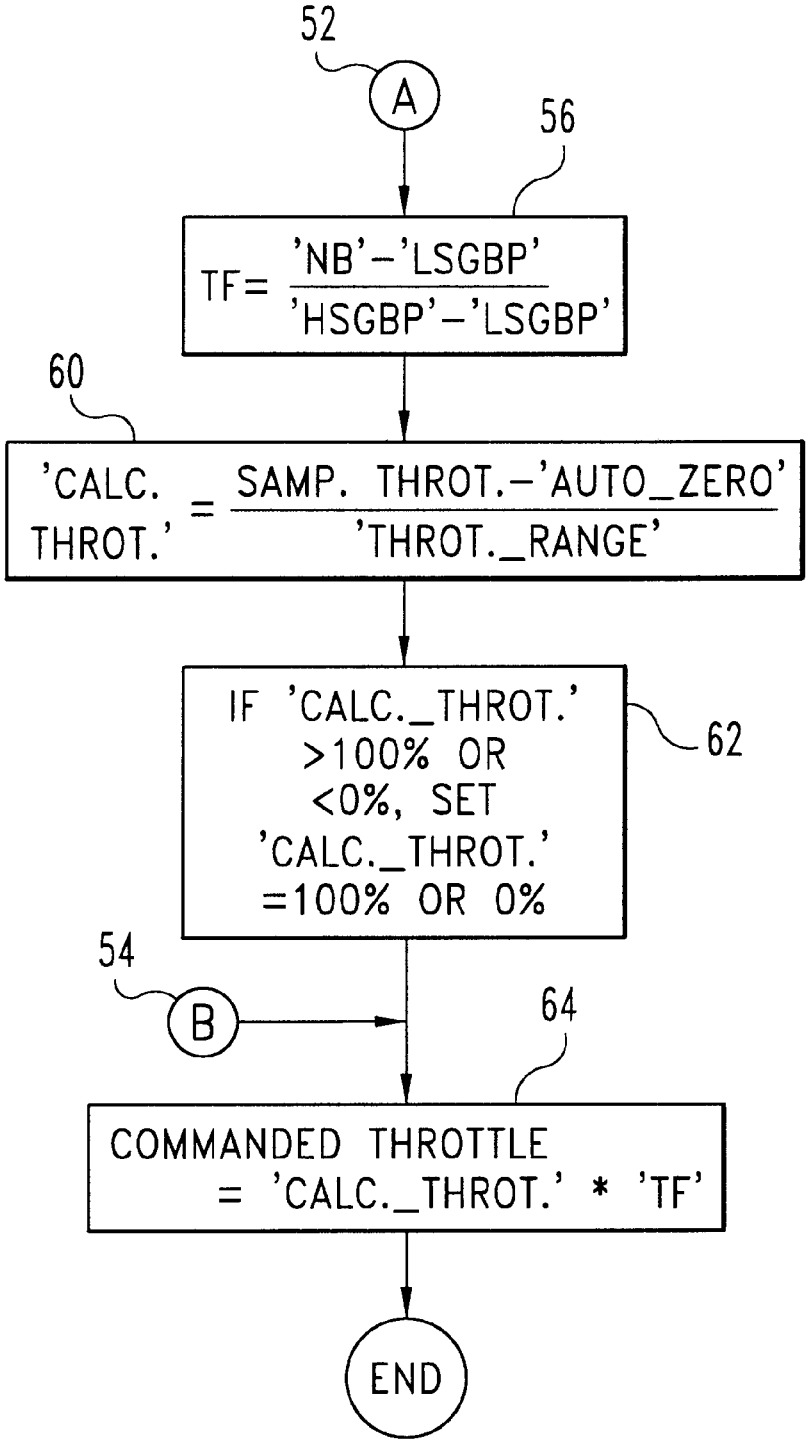

A more specific embodiment of the invention is depicted in the flow chart of FIGS. 6*a*–6*b*. Again, this sequence of steps can be implemented in the software within the ECM 15, and more particularly within the fuel command module 14 and commanded throttle module 20'. The starting step 30 of the routine is typically executed at predetermined intervals at which the throttle position is surveyed and the engine speed adjusted accordingly. In the specific embodiment, the engine control system has a throttle speed derate capability in which alternate torque curves can be applied to determine the appropriate engine speed based on the actual throttle position. Thus, in the conditional step 32 a determination is made as to whether this throttle speed derate feature has been enabled. If so, control passes to conditional step 34 to determine whether the standard or base-line torque curve has been selected. In the specific embodiment, this baseline curve is designated curve 0 so that a "yes" answer to the conditional 34 returns control to the primary rescaled throttle calculation loop. On the other hand, if a different torque curve from the baseline curve is selected, a new breakpoint speed value is assigned. This new breakpoint speed value is represented by the variable NB. The variable NB is assigned a value $NB_1$ or $NB_2$ if the first or second alternative torque curves, respectively, are selected. Of course, additional new breakpoint values can be assigned for additional alternate torque curves. Following the assignment of the value NB in step 36, the routine re-enters the algorithm at branch step 52.

If the speed derate has not been enabled, or if the base line torque curve has been selected, the routine flows to conditional step 38. In this conditional, a determination is made as to whether the constant speed cruise feature for the engine has been enabled. If this feature has not been enabled, the operator is not permitted to enter a different high-speed governor breakpoint speed. Thus, the throttle factor, TF, is set to unity (1.0), and control passes to branch step 54. On the other hand, if the constant cruise feature has been enabled, an additional query step is executed in step 40 to determine whether an alternative droop value has been entered by the vehicle operator. More specifically, the operator can select from several allowed settings corresponding to the base droop, or various alternative droop conditions. If the operator has not selected one of the allowed droop settings, control passes to step 42 in which the throttle factor is set to unity as described above. The assignment step 42 thus presumes that no breakpoints are enabled so the calculated throttle (value E in FIG. 4) is not re-scaled.

On the other hand, if an allowed droop setting has been entered by the vehicle operator, the algorithm continues to check the current throttle position against a threshold value to allow possible breakpoint adjustment by the operator. In conditional step 44, the current or commanded throttle is compared against a predetermined throttle threshold value adjusted by the prior throttle factor value TF. If the commanded throttle is less than or equal to the product of the threshold and the throttle factor, control passes to step 50 in which the new breakpoint variable NB is set to the value CB. The value CB is a user-adjustable value for the cruise breakpoint value. In step 50 the variable NB is set to the last entered value of CB.

On the other hand, if the commanded throttle is greater than to this threshold calculation, the vehicle operator is afforded the opportunity to adjust the value of the cruise breakpoint in step 46. Thus, the conditional step 44 does not permit breakpoint adjustment unless the user-requested throttle exceeds a certain adjustable threshold value. The threshold value is preferably stored in a memory of the ECM.

In step 46, a user input signal 48 can be applied to adjust the cruise breakpoint value CB, which ultimately corresponds to the user requested high idle breakpoint B discussed with respect to FIG. 4. In accordance with the preferred specific embodiment of the invention, two means are provided for user input or adjustment or the breakpoint value CB. In one approach, predetermined breakpoint values can be selected by the vehicle operator. In another approach, the operator is afforded the opportunity to increment or decrement a particular cruise breakpoint speed. In a further refinement of the second approach, a switch can be toggled to effect this increment or decrement of the breakpoint value CB. In one technique, momentarily toggling the switch will increase or decrease the value CB by a predetermined step value. In another technique, holding the switch constant causes the breakpoint value CB to ramp up or down at a predetermined ramping rate. The operator then releases the toggle when the breakpoint value CB is at the appropriate speed. In step 46, additional limitations are implemented to prevent the value CB from being set below a minimum value or above a maximum value. This min and max values can be maintained in a memory of the ECM 15. Following user adjustment of the cruise breakpoint speed, control passes to step 50 in which the new breakpoint value NB is set equal to the recently adjusted cruise breakpoint value CB.

In accordance with the illustrated embodiment, the calculation of the throttle factor TF occurs only where there has been a user adjustment of the cruise breakpoint (or the user requested high idle breakpoint), or the use of an alternative torque curve with the speed derate feature of the engine. Otherwise, if no speed derate has been selected, the constant cruise feature has not been activated, or no allowed droop identified, the throttle factor is set to unity (1.0) and control passes on branch step 54 past the throttle factor resealing feature of the invention.

The throttle factor TF is calculated in step 56. This step implements the equation set forth above in which the value NB corresponds to the user-requested high idle breakpoint value B (FIG. 4). The value LSGBP corresponds to the low speed governor breakpoint or minimum airspeed reference speed, A of FIG. 4 and the value HSGBP corresponds to the high speed governor breakpoint or the high idle breakpoint value C of the flow chart in FIG. 4. The remaining steps 60–64 are preferably performed by the commanded throttle component 20'. Specifically, the calculated throttle value is obtained from the sampled throttle signal 22 in relation to a zero throttle initialization value "auto-zero" and the full range of throttle motion value "throb-range". These latter values are specific to the particular throttle input device calibration factors. Thus, the calculated throttle value preferably ranges between zero and one hundred percent. In step 62, a test is made to insure that the calculated throttle value does not exceed one hundred percent or fall below zero percent. In the final step of the inventive routine, the commanded throttle value that is utilized to govern the engine speed is equal to the product of the calculated throttle based upon user depression of the throttle pedal 25, and the throttle factor TF calculated in step 56. The routine then ends to be recalled at predetermined time intervals to sample the throttle position and adjust the engine speed accordingly.

Figure 5:
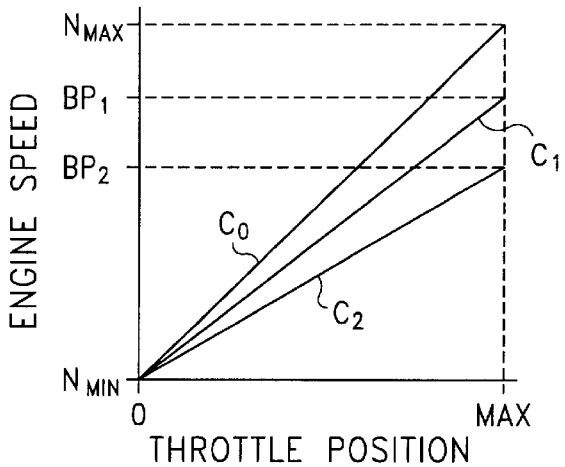
FIG. 5 is a graph illustrating engine speed as a function of throttle position utilizing the system and method of the present invention.

The effect of the throttle factor employed according to the present invention is depicted in the graph of FIG. 5. In particular, this graph shows the two breakpoint value $BP_1$ and $BP_2$. As the graph illustrates, the throttle can be moved between its zero position and maximum position, i.e. over its full range of motion, for both breakpoint speeds along corresponding curves $C_1$, and $C_2$,. Thus, the present invention eliminates the deadband experienced with previous engine throttle control systems. It is understood that the curves $C_1$ and $C_2$ need not be linear. Instead the curves will follow the form of the baseline throttle curve $C_0$, but scaled so the max throttle position corresponds to the breakpoint speed. The curves $C_1$ and $C_2$ do not include any portion over which changes in throttle position fail to produce changes in engine speed.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

For example, in the preferred embodiment, the throttle deadband is eliminated by the inventive system and method. The throttle factor applied to the operator-input or calculated throttle can be further modified to provide a known throttle deadband. With this variation, the known deadband would remain constant over all operating circumstances of the ECM. In the illustrated embodiment, the inventive throttle factor adjusts or rescales the effective slope of the throttle position vs. engine speed curve between the minimum and maximum throttle positions. The algorithm disclosed in FIGS. 4 or 6*a–b* can be modified so the curve is rescaled to a different maximum throttle position. The modified algorithm alters the throttle factor (TF) by the ratio of the maximum throttle position relative to the maximum position reduced by the desired deadband.

In other words, the modified algorithm can include an additional step in the block flowchart of FIG. 4 after the calculation of TF (or value D) to generate a modified throttle factor. This step can apply the equation:

$$D = D * \frac{T_{\max}}{T_{\max} - DB},$$

where $T_{max}$ is the maximum throttle position and DB is the desired deadband.

The remainder of the algorithm in FIG. 4 continues as previously described using the modified throttle factor value D. In this instance, the all-speed reference speed calculation can generate a speed in excess of the user-requested high idle breakpoint. Thus, the all-speed governor element 19*c* would be invoked to limit the engine speed to the requested breakpoint speed, even as the throttle is further depressed to its maximum position. The additional step permits operator entry of a deadband value DB, which can vary from zero to a preset limit, say 85%.

What is claimed is:

1. An system for controlling fueling signals provided to fueling system of an internal combustion engine, comprising:

a throttle input device operable to generate a throttle signal as a function of the position of the throttle input device, in which said throttle input device is substantially continuously variable between a minimum position and a maximum position;

a fueling command component receiving said throttle signal as an input and operable to generate fueling signals as a function of said throttle signal corresponding to a minimum engine speed when said throttle input device is at said minimum position and a maximum engine speed when said throttle input device is at said maximum position;

an engine speed governor having an input for receiving a user-requested breakpoint speed different from said maximum engine speed, said governor operable to limit said fueling signals to limit the speed of the engine to said breakpoint speed; and means for resealing said throttle signal so that said maximum position of said throttle input device corresponds to said breakpoint speed.

2. The system for controlling fueling signals according to claim 1, wherein said means for resealing includes:

a calculation element receiving said minimum engine speed as an input A, said breakpoint speed as an input B and said maximum engine speed as an input C and operable to calculate a throttle factor TF according to the equation $$TF = \frac{B - A}{C - A};$$

and a multiplier element to multiply said throttle signal by said throttle factor to provide a rescaled throttle signal.

3. The system for controlling fueling signals according to claim 1, wherein:

said fueling command component generates said fueling signals according to a predetermined relationship of engine speed to said throttle signal between said minimum and maximum positions of said throttle input device; and said means for resealing is operable to rescale said predetermined relationship.

4. The system for controlling fueling signals according to claim 1, wherein:

said fueling command component generates said fueling signals according to a predetermined linear relationship of engine speed to said throttle signal having a slope between said minimum and maximum positions of said throttle input device; and said means for resealing is operable to rescale said slope of said predetermined linear relationship.

5. The system for controlling fueling signals according to claim 1, wherein said means for resealing is operable to rescale said throttle signal so that an intermediate position of said throttle input device less than said maximum position corresponds to said breakpoint speed, thereby introducing a predetermined constant deadband to said throttle input device.

6. The system for controlling fueling signals according to claim 2, wherein said means for resealing is operable to rescale said throttle signal so that an intermediate position of said throttle input device less than said maximum position corresponds to said breakpoint speed, thereby introducing a predetermined constant deadband to said throttle input device.

7. The system for controlling fueling signals according to claim 6, wherein said means for resealing includes a second multiplier element to further multiply said throttle signal by the ratio of said maximum throttle position to said intermediate throttle position.

8. A method for controlling fueling signals provided to the fueling system of an internal combustion engine to eliminate the throttle deadband at limit speeds below the maximum engine speed, the engine having a throttle input device operable between a minimum position corresponding to a minimum engine speed and a maximum throttle position corresponding to the maximum engine speed, comprising the steps of:

providing an engine breakpoint speed different from the maximum engine speed;

calculating a throttle factor as a function of the ratio of the difference between the breakpoint speed and the minimum engine speed relative to the difference between the maximum and minimum engine speeds;

calculating a throttle signal based on the position of the throttle input device between the minimum and maximum positions;

resealing the throttle signal by multiplying the throttle signal by the throttle factor to thereby eliminate the throttle deadband; and providing the rescaled throttle signal to a fueling command component of an engine control module, the fueling command component operable to generate fueling signals as a function of the throttle signal.

9. The method for controlling fueling signals according to claim 8, wherein the step of providing an engine breakpoint speed includes reading the breakpoint speed from a manually actuated input device.

10. The method for controlling fueling signals according to claim 8, wherein the steps are continuously performed during operation of the engine.

11. The method for controlling fueling signals according to claim 8, further comprising the step of altering the throttle factor prior to resealing the throttle signal by multiplying the throttle factor by the ratio of said maximum throttle position to an intermediate throttle position to thereby introduce a predetermined constant throttle deadband.

12. The method for controlling fueling signals according to claim 11, further comprising the step of providing user input of the intermediate throttle position.

* * * * *

UNITED STATES PATENT AND TRADEMARK OFFICE

CERTIFICATE OF CORRECTION

PATENT NO. : 6,196,188 B1
DATED : March 6, 2001
INVENTOR(S) : Dusan M. Janic and Randal L. Bergstedt It is certified that error appears in the above-identified patent and that said Letters Patent is hereby corrected as shown below:

Title page,
Item [73] -- Assignee: Cummins Engine Company, Inc., Columbus, Indiana. --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*